US007637355B2

(12) United States Patent
Tyni

(10) Patent No.: US 7,637,355 B2
(45) **Date of Patent: *Dec. 29, 2009**

(54) ELEVATOR ARRANGEMENT

(75) Inventor: Tapio Tyni, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

This patent is subject to a terminal disclaimer.

(21) Appl. No.: 12/068,861

(22) Filed: Feb. 12, 2008

(65) Prior Publication Data

US 2008/0179143 A1 Jul. 31, 2008

Related U.S. Application Data

(63) Continuation of application No. PCT/FI2005/000378, filed on Sep. 5, 2005.

(51) Int. Cl.
*B66B 13/14* (2006.01)

(52) U.S. Cl. ..... 187/316; 187/315; 187/317

(58) Field of Classification Search ..... 187/316, 187/317, 315; 318/432

See application file for complete search history.

(56) References Cited

U.S. PATENT DOCUMENTS 5,159,162 A * 10/1992 Tatino ..... 187/280
5,274,312 A 12/1993 Gerstenkorn
5,378,861 A 1/1995 Barten et al.
5,503,248 A * 4/1996 Peruggi et al. ..... 187/316
5,587,565 A * 12/1996 Schroder-Brumloop et al. ..... 187/316
5,625,175 A 4/1997 Gutknecht et al.
5,864,104 A 1/1999 Tawada et al.
7,423,398 B2 * 9/2008 Tyni et al. ..... 318/432
2003/0000777 A1 1/2003 Barreiro et al.
2003/0217894 A1 * 11/2003 Perala et al. ..... 187/316

FOREIGN PATENT DOCUMENTS

EP 1 544 152 A1 6/2005
WO WO 2005073119 A2 * 8/2005

* cited by examiner

*Primary Examiner*—Walter Benson
*Assistant Examiner*—Kawing Chan
(74) *Attorney, Agent, or Firm*—Birch, Stewart, Kolasch & Birch, LLP

(57) ABSTRACT

The method of the invention can be used to improve the performance of an elevator system. In the method, the acceleration and/or velocity of at least one door in the elevator system is measured and a dynamic model of the door is created. Using the model, an estimation of acceleration and velocity can be calculated as a function of unknown parameters. From the estimated acceleration or velocity and the measured acceleration or velocity an error function is obtained, and a search is performed in an optimizer to find its minimum value. The unknown parameters corresponding to the minimum value indicate the value of the kinetic parameters of the door at the instant being considered. By utilizing the calculated values of the kinetic parameters, the functions of the doors in the elevator system are optimized separately for each door. Using a genetic algorithm, it is possible to determine, in addition to the unknown kinetic parameters, the operational state of the door closing device as well.

23 Claims, 5 Drawing Sheets

ELEVATOR ARRANGEMENT

Figure 1:
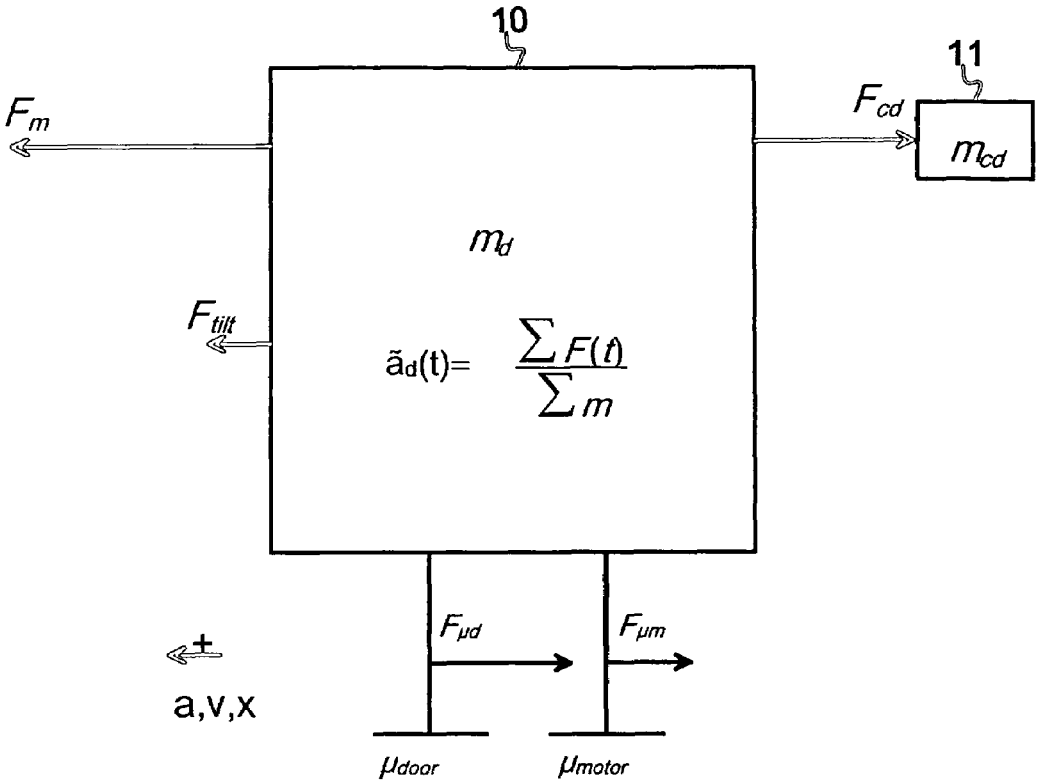

This application is a Continuation of co-pending Application No. PCT/FI2005/000378 filed on Sep. 5, 2005, and for which priority is claimed under 35 U.S.C. § 120. The entire contents of all are hereby incorporated by reference.

FIELD OF THE INVENTION

The present invention relates to optimization of the functions of computer controlled elevator doors in an elevator system to improve the performance of the elevator system.

BACKGROUND OF THE INVENTION

A mechanical system in normal operational condition involves a certain number of motion-resisting forces arising from various phenomena. If the magnitudes of these forces can be established via measurement or calculation, then it is possible to utilize this information to optimize the operation of the system.

An elevator system comprises numerous mechanically movable parts that are subject to a number of forces resisting motion, such as e.g. frictional forces and the inertial and gravitational forces caused by movable masses. An elevator door that moves automatically on a horizontal rail is one of such parts, which is acted on by forces from different directions and is both at its upper and lower edges in contact with rails that keep the door motion on track. The magnitude of the forces resisting the motion of elevator doors varies between different elevator systems. Often the magnitude of these forces also changes during the operation of the elevator system. Direct continuous measurement of motion-resisting forces is often difficult to implement; for example, a separate "friction meter" can not be advantageously mounted on an elevator door. Therefore, the magnitude of each force resisting the door motion is preferably measured indirectly. It is possible to create a model of the system in question, i.e. in this case the elevator door, wherein the forces applied to the door are observed. The forces acting in the model include frictional forces resisting door motion, mass of the door and forces produced by the door closing device. By using the model, it is possible to calculate desired parameters when the magnitudes of the tractive forces opening and closing the door are known and the acceleration or velocity of the door is measured. This makes it possible to solve unknown parameters, such as frictional force, door mass and the horizontal force component applied to the door. When the above-mentioned parameters, the so-called kinetic parameters are known, door-operations such as opening and closing can be controlled accurately and in an optimal manner as regards the elevator system, thereby improving the performance of the elevator system. Thus, we are dealing with a problem of optimization and parameter estimation.

In an elevator system, the door assembly consists of a car door moving with the car and the landing doors on different floors. A modern automatic elevator door is opened and closed by a door operator integrated with the elevator car and using e.g. a direct-current motor to open and close the elevator doors at each floor level. The torque produced by the direct-current motor is directly proportional to the motor current. The energy of the motor is coupled to the door e.g. via a cogged belt, and the door slides on rollers. For reasons of safety, the landing door alone is closed without a motor by means of a closing device. The closing force of the closing device can be produced by a closing weight or a helical spring. The motor current and the corresponding torque are measured either from a motor controller card or directly from the motor current lead. Another motor parameter that can be monitored is the so-called tacho pulse signal. The tacho signal typically consists of a square wave whose frequency is dependent on the speed of the motor and therefore the door speed.

A problem with prior art is that the elevator system generally comprises a plurality of doors, whose kinetic parameters may vary widely between different doors. The number of parameters may also be large. For example, a building with 8 elevators serving 30 floors contains 240 doors, for each of which several kinetic parameters should be determined. In such cases, it is thus very laborious, often almost impossible to determine all the parameters. A prior-art solution is to define suitable kinetic parameters for the heaviest door in the elevator system when the system is commissioned and to use these parameters for the control of all doors in the elevator system. Typically, the heaviest door is located in the entrance lobby of the building and may weigh e.g. 130 kg, whereas the doors on the floor levels may have a mass of only 100 kg. In other words, in prior-art solutions no door-specific optimization of operations is performed. For example, the control parameters for the motor controller controlling door operation are not optimized, nor are the speed profiles of different doors in the elevator system. In the example case mentioned above, it is possible to increase the transportation capacity of the elevator system by 2.3% and to shorten the average passenger waiting time by 5% by optimizing the speed profile of the landing doors for a mass of 100 kg instead of 130 kg. A further drawback with prior-art solutions is that the door motor controller may oscillate as the motor load varies, causing unnecessary mechanical stress while the time needed to perform door operations increases unreasonably. Thus, there is a need for an automatic method for determining the kinetic parameters of the doors in an elevator system to optimize door operations so as to allow the performance of the elevator system to be improved.

OBJECT OF THE INVENTION

The object of the present invention is to overcome the above-mentioned drawbacks of prior art and to achieve a new type of solution that will make it possible to improve the performance of an elevator system via door-specific optimization of door operations in the elevator system. A further object of the invention is to achieve one or more of the following objectives:

- ensure safe operation of elevator doors in all operational situations
- enable consideration of the traffic situation of an elevator system and passenger-specific needs in the execution or door operations.
- reduce failures and premature wear of the doors in an elevator system.
- facilitate and accelerate the start-up of an elevator system.

BRIEF DESCRIPTION OF THE INVENTION

The method and the system of the invention are characterized by what is disclosed in the claims.

Inventive embodiments are also presented in the description part and drawings of the present application. The inventive content disclosed in the application can also be defined in other ways than is done in the claims below. The inventive content may also consist of several separate inventions, especially if the invention is considered in the light of explicit or implicit sub-tasks or in respect of advantages or sets of advantages achieved. In this case, some of the attributes contained in the claims below may be superfluous from the point of view of separate inventive concepts. Within the framework of the basic concept of the invention, features of different embodiments of the invention can be applied in conjunction with other embodiments.

The present invention concerns a method for improving the performance of an elevator system. The elevator system comprises at least one elevator, and the elevator comprises one or more elevator doors and at least one door operator for opening and closing the aforesaid elevator door or doors. In the method, the acceleration and/or velocity of at least one of said elevator doors as well as the torque of the door motor moving the door are measured. For the elevator door, a dynamic model incorporating the forces acting on the elevator door is created. Further in the method, by utilizing the aforesaid measured acceleration or velocity and the measured torque as well as the dynamic model of the elevator door, kinetic parameters of the elevator door are estimated. Using the estimated kinetic parameters, the operation of the elevator door is optimized to improve the performance of the elevator system.

The present invention also concerns a system for improving the performance of an elevator system. The elevator system comprises at least one elevator, and the elevator comprises one or more elevator doors and at least one door operator for opening and closing the aforesaid elevator door or doors. The system further comprises

- means for measuring the acceleration and/or velocity of the elevator door as well as the torque of the door motor moving the elevator door;
- a dynamic model of the elevator door, comprising the forces acting on the elevator door;
- means for estimating kinetic parameters of the elevator door by utilizing the measured acceleration or measured velocity and the measured torque of the motor moving the elevator door as well as the dynamic model;
- means for optimizing the functions of the elevator door by utilizing the estimated kinetic parameters to improve the performance of the elevator system.

The dynamic model of the elevator door is an essential part of the present invention. Some of the kinetic parameters of the model are updated after each clean door sequence. 'Clean door sequence' refers to door opening and closing actions where the door is not reopened during the closing action. The model contains the door and the closing device as well as the forces applied to these, including the frictional force. By utilizing the model, the acceleration and/or velocity of the door is/are estimated as a function of time. The measured and the estimated instantaneous values are compared to each other, thus obtaining an error term. For each instant, the error term is a function of three variables (door mass, frictional force applied to the door and a force caused by inclination of the door). Next, the sum of the squares of the error terms is calculated, weighting each square of an error term by a desired weighting coefficient. For the squared error term thus obtained, a minimum value is found, in which situation the three parameters searched for are best in keeping with reality.

By applying the method and system of the present invention, the operation of the elevator doors of an elevator system can be optimized in real time. In this context, 'elevator door' refers to a horizontally sliding door consisting of an elevator car door and a landing door, which is controlled by a motor and whose closing may be assisted by a closing device. The operation of the door is affected by several different kinetic parameters, among which the parameters of special interest at present are door mass, magnitude of the frictional force applied to the door, magnitude of the horizontal force component applied to the door and operational state of the door closing device. By using the kinetic parameters, the operation of the door can be optimized. Via the parameters it is possible to define e.g. the control parameters of the motor controller controlling door operation, define for the door an optimal velocity profile of the closing sequence and/or opening sequence such that the highest instantaneous and/or average kinetic door energy allowed by regulations is not exceeded, or change the velocity profile of the door on the basis of the traffic situation of the elevator system and/or passenger-specific special needs.

In an embodiment of the invention, the acceleration of the elevator door is measured by using an acceleration sensor, which is preferably placed on a movable door leaf of the elevator door.

In an embodiment of the invention, the speed of the elevator door is measured by using a signal proportional to velocity or position, obtained from the door motor. In this embodiment, the speed is measured by using a so-called tacho signal obtained from the door motor. The tacho signal is a square wave in which the pulse interval depends on the speed of the door motor and therefore of the door. From the tacho signal it is possible to calculate the door speed. Alternatively, it is possible to use a so-called absolute sensor mounted on the door motor or on a door leaf to measure the angle of rotation of the motor or the position of the door leaf relative to a given reference. By deriving the position signal of the absolute sensor, a signal proportional to door speed is obtained.

In an embodiment of the invention, the input parameters used in the dynamic model consist of one or more of the following parameters: acceleration of the elevator door, velocity of the elevator door, current of the motor actuating the elevator door, torque coefficient of the motor, frictional torque of the motor, force factor of the closing spring of the elevator door, mass of the closing weight, and operational state of the closing device.

In an embodiment of the invention, using the dynamic model of the elevator door, one or more of kinetic parameters of the elevator door is/are estimated, said parameters being mass of the elevator door, frictional force applied to the elevator door, force caused by the angle of tilt of the elevator door, and operational state of the closing device.

In an embodiment of the invention, the acceleration or velocity of the elevator door is modeled in the dynamic model of the elevator door as a function of one or more parameters. These parameters are mass of the elevator door, frictional force applied to the elevator door, force caused by the angle of inclination of the elevator door, and operational state of the closing device. Further, in this embodiment a first error function is calculated either as the difference between the measured instantaneous acceleration of the elevator door and the instantaneous acceleration of the elevator door modeled in the model or as the difference between the measured instantaneous velocity of the elevator door and the instantaneous velocity of the elevator door modeled in the model. In this embodiment, a second error function is calculated by squaring the first error function and summing the squared first error functions obtained over a certain time interval with desired weighting coefficients. One or more of the parameters mass of the elevator door, frictional force applied to the elevator door and force caused by the angle of inclination of the elevator door is/are calculated by minimizing the second error function, and the calculated parameters are fed back to the dynamic model for use in the next calculation cycle. Finally, one or more of the calculated kinetic parameters are passed to the controller of the door operator of the elevator door to optimize the functions of the elevator door.

In an embodiment of the invention, one or more of the kinetic parameters of the elevator door are determined in connection with the start-up of the elevator, and these parameters are defined as constant parameters in the dynamic model of the elevator door. By fixing among the variables one or more of the kinetic parameters of the door, the calculation can be simplified. To do so, the desired kinetic parameters are determined in connection with the start-up or commissioning of the system by taking the average of the parameters for a desired number of door operations. The length of the "teaching period" considered may be e.g. about twenty door operations. Once the parameters in question have been defined as the average of the results of the teaching period, they are set as constant parameters. After this, the optimization logic processes functions in which these parameters are constants, so the processing of the functions requires less computing power and time than before. For example, the door mass can be fixed because it can be assumed that the mass will not change significantly in normal operational conditions.

In an embodiment of the invention, a genetic algorithm (GA) is used to detect failure of the door closing device. According to this embodiment, the genetic algorithm comprises a chromosome that consists of genes describing the operational state of the closing device, the frictional force applied to the door and the force caused by the angle of inclination of the door. As a goodness value of the genetic algorithm, a squared error function is used, and the dynamic model of the door is used in the determination of the phenotype of the genetic algorithm. The genetic algorithm (GA) provides the advantage that a failure of the door closing device can be detected immediately. Using the GA, it is possible to simultaneously determine both a correct model of the door system (closing device included or not) and unknown forces related to door friction and door inclination. The parameters of the dynamic model of the door are encoded on a chromosome of the genetic algorithm. In this context, the unknown parameters related to the operation of the closing device, the frictional force applied to the door and the force caused by the angle of inclination are genes, in other words, these parameters together form a chromosome. The goodness function of the chromosome is the squared error function, which can be conceived of as an indicator of the performance of the solution, i.e. phenotype, represented by the chromosome. With different gene values, i.e. alleles, correspondingly different phenotypes are obtained, from which, as a final result of a search, the GA optimizer ends up with the phenotype giving the minimum value. The gene values corresponding to this phenotype indicate the operational condition of the door system at the instant being considered.

In an embodiment of the invention, one or more of the control parameters of the door motor controller, which are gain of the controller and magnitude of the feedforward torque value, are determined by utilizing the kinetic parameters of the elevator door. With an optimal controller gain and feedforward torque value, accurate door motor movements are achieved and controller oscillations can be reduced with different loads of the door motor. As a final result, an acceleration of the movements of the elevator door and a reduction of the force components caused by controller oscillations and straining the door operator mechanism are achieved.

In an embodiment of the invention, the elevator door speed profile is determined by using one or more auxiliary parameters, which are maximum allowed instantaneous kinetic energy of the elevator door, average allowed kinetic energy of the elevator door, traffic condition of the elevator system, passenger-specific identification data. The safety standards concerning elevator systems generally define for elevator doors a maximum allowed average kinetic energy and/or a maximum allowed instantaneous kinetic energy during the closing motion of the door. By optimizing the speed profiles of different doors in the elevator system by using the aforesaid kinetic energy values, the speeds of motion of the doors and at the same time the performance, such as the transportation capacity, of the entire elevator system are optimized. On the other hand, in situations where the number of passengers using the elevator system is small, it is possible to reduce the door speeds, thereby improving ride comfort in the elevator system and reducing the force components straining the door operator mechanics. Similarly, special needs of different passengers can be taken into account in the calculation of the speed profile, e.g. by slowing down door motions when a passenger in a wheelchair is traveling in the elevator system.

In an embodiment of the invention, the estimated kinetic parameters of one or more elevator doors are stored in the elevator system, preferably in the door operator controlling door functions. From among the stored parameters, the parameters to be used in each case for the optimization of door operations are selected for use on the basis of an external selection signal.

In an embodiment of the invention, the external signal used for the selection of kinetic parameters is a signal indicating the destination floor, said signal being generated in the elevator control system or in the group control of the elevator system.

In an embodiment of the invention, the external signal used for the selection of kinetic parameters is a signal generated by a floor detector moving with the elevator car.

LIST OF FIGURES

Figure 2:
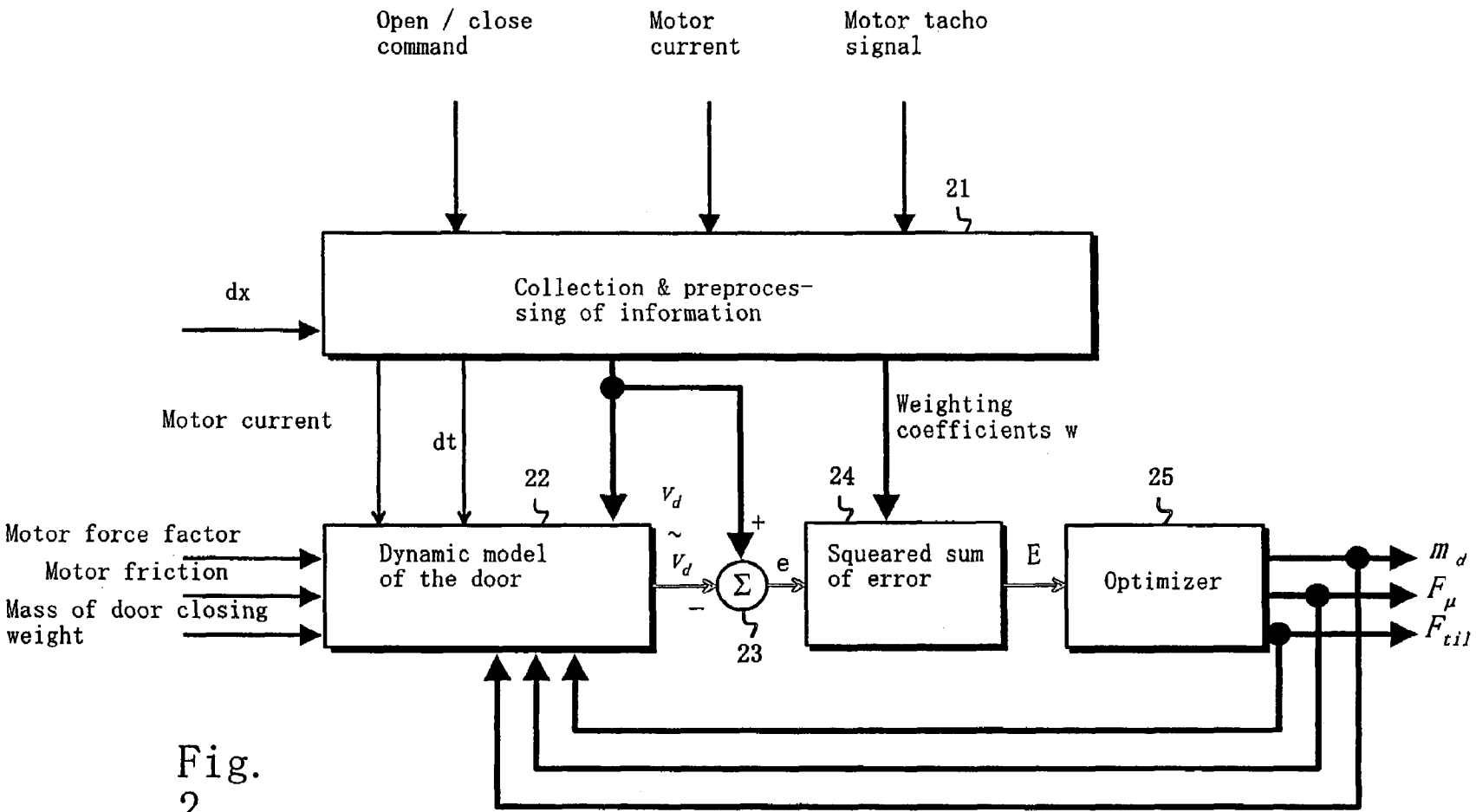
Figure 3:
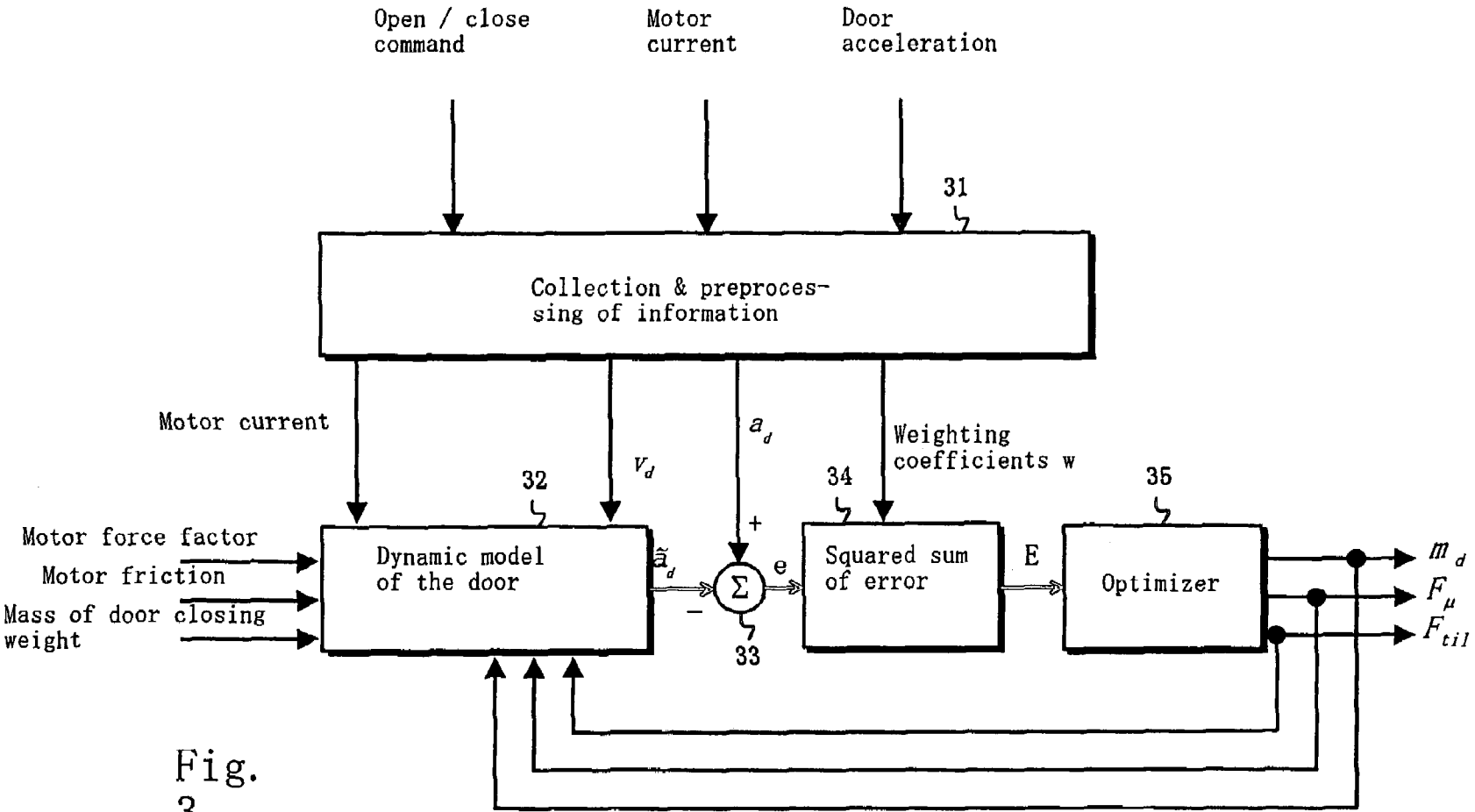
Figure 4:
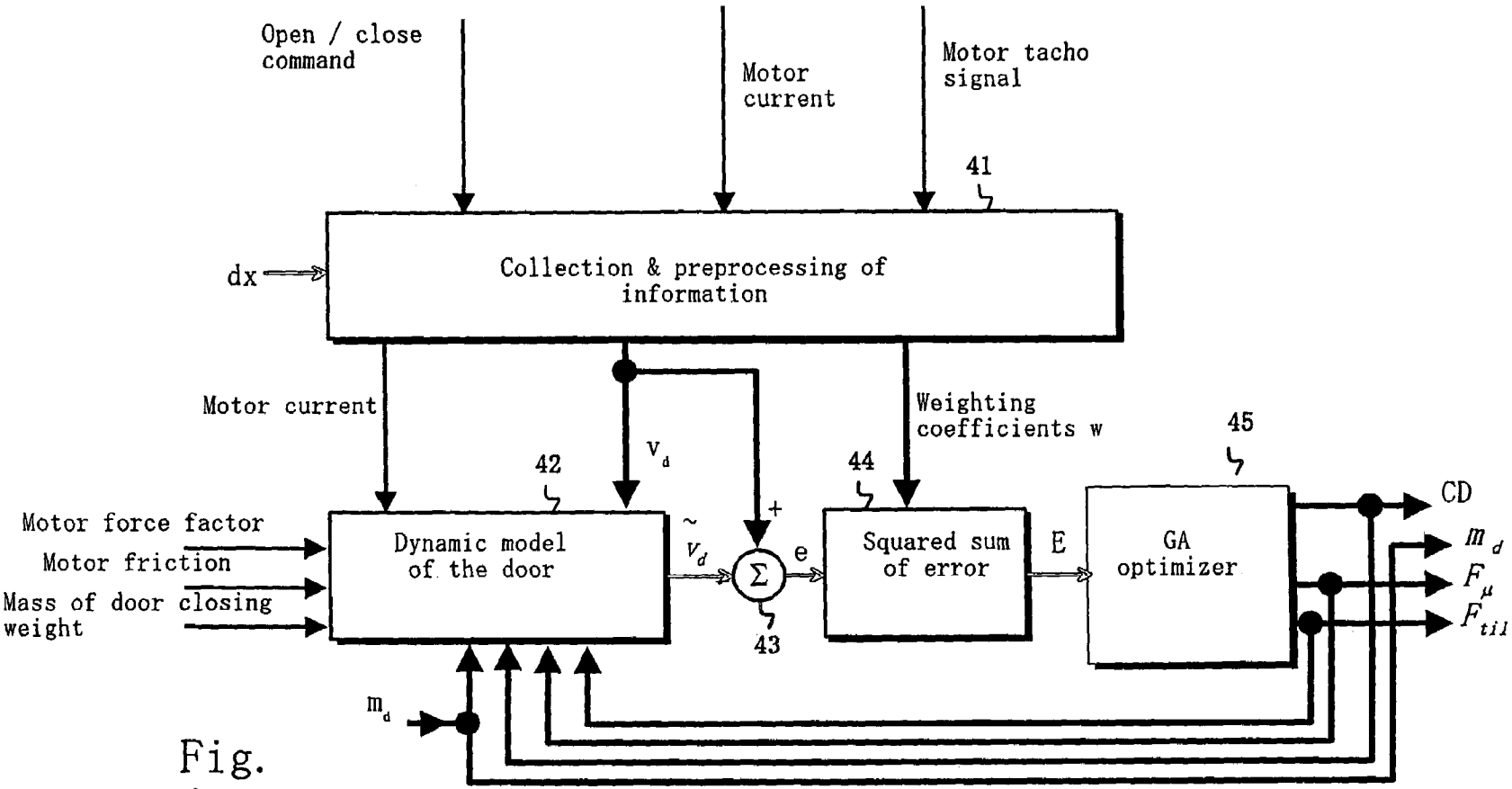
Figure 5:
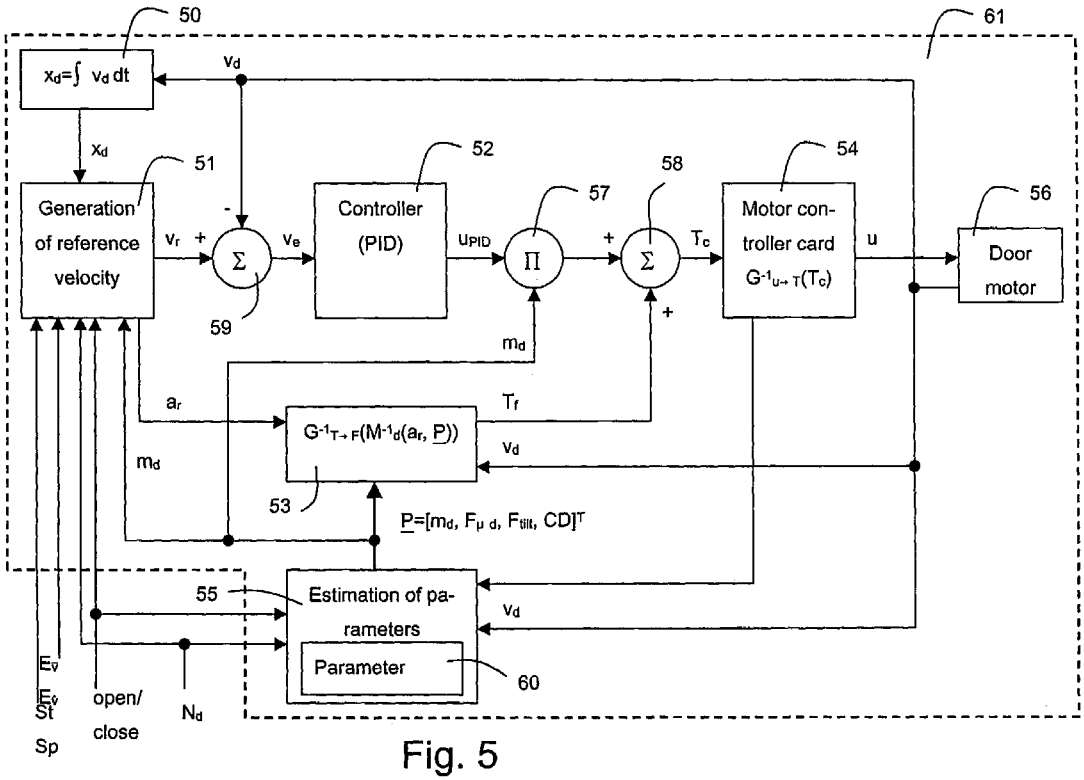

FIG. 1 presents a dynamic model of a door according to the present invention, FIG. 2 represents a method according to the present invention for determining the unknown kinetic parameters of the model, FIG. 3 represents a second method according to the present invention for determining the unknown kinetic parameters of the model, FIG. 4 represents a third method according to the present invention for determining the unknown kinetic parameters of the model, and FIG. 5 presents a functional block diagram of a system according to the present invention.

DETAILED DESCRIPTION OF THE INVENTION

To determine the forces acting on the doors in an elevator system, a dynamic model is created for the doors, wherein the forces acting on the doors are considered. A dynamic model of a door is presented in FIG. 1. The basic law applied is Newton's second law, whereby the force acting on an object is obtained as the result of the mass of the object and its acceleration. Another basic law relating to friction gives the magnitude of the frictional force resisting motion of the object as the result of a friction coefficient and the force pressing the object against the surface in question (for an object moving on a level surface, the force of gravitation). In the dynamic model, all moving masses are assumed to be concentrated on an individual mass point $m_d$ for the sake of simplicity. Correspondingly, all frictional forces acting in the system, except for the motor friction, can be combined as a single concentrated frictional force term $F_{\mu m}$. Dynamic operation of the door system can be modeled using five different forces having an influence on it: force of the motor, force caused by a closing weight or spring, force caused by the angle of inclination of the door, internal frictional force of the motor, and frictional force caused by the door. The total mass of the system consists of the concentrated mass of the door 10 and the mass of a possible closing weight 11. Concentrated in the door mass $m_d$ are all the moving masses comprised in the door mechanics. FIG. 1 presents the mass points of the system, the forces present in it and the positive direction of velocity and acceleration. From the dynamic model and Newton's second law, expression (1) for instantaneous acceleration $\tilde{a}_d(t)$ of the door 10 is obtained:

$$\tilde{a}_d(t) = \frac{F_m(t) + F_{tilt} - F_{cd}(x_d(t)) - \text{sign}(v_d(t)) \cdot (F_{\mu m} + F_{\mu d})}{m_d + m_{cd}}, \quad (1)$$

where $F_m = Bl \cdot I_m(t)$ and $F_{cd}(x_d(t)) = m_{cd} \cdot g$ when the closing device is a weight and $F_{cd}(x_d(t)) = k_{cd}(x_{d0} + x_d(t))$ when the closing device is a spring. Bl is the torque coefficient of the motor, $I_m$ is the motor current, $F_m$ is the force caused by the motor, $F_{tilt}$ is the horizontal component of the force caused by inclination of the door, $F_{cd}$ is the force caused by the closing device, $F_{\mu m}$ is the internal frictional force of the motor, $F_{\mu d}$ is a concentrated frictional force acting on the door and resulting from all the sub-components, $m_d$ is the common concentrated mass of all masses of the door, and $m_{cd}$ is the mass of the counterweight. If the closing device is a spring, then $m_{cd}=0$. Since a closing weight is the more widely used closing device, it will be exclusively dealt with in the subsequent description. However, this does not mean that the device of the invention is exclusively limited to a closing weight; instead, the closing device may consist of a mechanism that gets its closing force from a spring or some other arrangement.

When the quantities to be measured about the door are sampled by the apparatus of the invention to determine the kinetic parameters, a transition from the continuous-time world to discrete representation takes place. Expression (1) now changes to the form $$\tilde{a}_{d,k} = \frac{F_{m,k} + F_{tilt} - F_{cd}(x_{d,k}) - \text{sign}(v_{d,k}) \cdot (F_{\mu m} + F_{\mu d})}{m_d + m_{cd}} \quad (2)$$

where instant t has been replaced by a sample taken at that instant with current number k.

Among the parameters of the dynamic model of the door, those to be known beforehand are mass of the closing weight, torque coefficient of the motor and internal friction moment of the motor. The mass of the closing weight can be easily determined by weighing. The torque coefficient of the motor and the internal friction moment $T_{\mu m}$ of the motor can be determined by using a dynamometer or from the specifications given by the motor manufacturer. Using a dynamometer, the torque of the motor can be measured as a function of motor current. The results for different current values form an approximately straight line T, which is represented by the equation $$T(I_m) = Bl \cdot I_m - T_{\mu m} - T_{\mu Dyn} \quad (3)$$

where $T(I_m)$ is the motor torque and $T_{\mu Dyn}$ is the friction of the dynamometer, which is assumed to be known. Via linear regression, the unknown variables Bl and $T_{\mu m}$ are determined as the angular coefficient of the regression line and the intersection of the y-axis.

The force acting on the door can be determined from the motor torque by taking the power transmission mechanisms of the door mechanism into account. In the example case, the motor shaft is provided with a belt pulley of radius r, around which runs a cogged belt moving the door leaves. Thus, the force moving the door leaves is easily obtained as $F_m = T/r$.

From the model again it is possible to determine the unknown parameters, which in the present connection are mass of the door, force caused by tilt and frictional force acting on the door.

One solution for determining the unknown kinetic parameters is presented in FIG. 2. The motion of the elevator door 20 is controlled by a control logic (not shown in FIG. 2), which gives the command to open or close the door. The door is moved by a direct-current motor connected to a motor controller card. From this card it is possible to directly measure the motor current, which is proportional to the motor torque, and the so-called tacho signal. The tacho signal is obtained from the motor's tacho generator, which detects the mechanical speed of rotation of the motor. In this embodiment, the tacho signal is typically a signal of square wave form. The frequency and pulse interval of the square wave signal are proportional to the speed of the door motor and the door. Between two successive pulses, the door always moves through the same partial distance dx.

The signals obtained from the motor controller card and the commands given by the control logic are passed to a functional block 21 performing the collection and pre-processing of information. In this block, the door motion data are filtered to exclude those door opening operations where the door has to be re-opened during a closing movement due to an obstacle, typically a passenger, appearing in the path of the door. During the time interval dt between two tacho pulses, the door moves through a constant partial distance dx. In block 21, the door velocity $v_d$ at each instant k of time can now be calculated:

$$v_{d,k} = \frac{dx}{dt_k} \quad (4)$$

The preprocessing block also contains weighting coefficients for subsequent calculation of the error term. Using weighting coefficients, desired error terms can be weighted more than the others. In the preprocessing block 21, all information relating to door opening and closing operations is combined for further processing.

After this, the next step in the method is processing of the dynamic model 22 of the door. The model was described above and is depicted in FIG. 1. As stated above, the input parameters of the model are motor torque coefficient, frictional torque of the motor, mass of the door closing weight, motor current, period of time dt and door speed $v_d$. In the model, the acceleration of the door is estimated as a function of three variables as follows:

$$\tilde{a}_{d,k}(m_d, F_\mu, F_{tilt}) = \frac{\sum F_k(m_d, F_\mu, F_{tilt})}{\sum m} \quad (5)$$

where $\Sigma F_k(m_d, F_\mu, F_{tilt})$ is the sum of the forces acting on the door at instant k. From the estimated door acceleration, the velocity of the door can be estimated as follows:

$$\tilde{v}_{d,k}(m_d, F_\mu, F_{tilt}) = v_{d,0} + \sum_k \tilde{a}_{d,k}(m_d, F_\mu, F_{tilt}) \cdot dt_k, \quad (6)$$

where $v_{d,0}$ is the door speed at instant t=0.

In the next step, the estimated door speed and the door speed calculated in the preprocessing block are passed to a differentiating block 23. From the measured instantaneous velocity is subtracted the estimated instantaneous velocity, and the result obtained is the error term $e_k$. This error term $e_k$ is a function of three variables, $m_d$, $F_m$ and $F_{tilt}$. Using weighting coefficients $w_k$, a so-called squared error term E can be calculated in block 24:

$$E(m_d, F_\mu, F_{tilt}) = \sum_k w_k e_k(m_d, F_\mu, F_{tilt})^2 = \min, \quad (7a, 7b)$$

$$e_k = \tilde{v}_{d,k} - v_{d,k}$$

Next in the block diagram of the method of the present invention, the squared error term E is passed to an optimizer 25. The function of the optimizer is to minimize the function (7a) of the three variables. When the minimum value is found, the variable parameters corresponding to it have been estimated for the door mass, the frictional force resisting the door motion and the frictional force caused by the angle of inclination of the door.

FIG. 3 presents another example for determining the kinetic parameters. The operation in this example resembles very closely to the procedure illustrated in FIG. 2. The control logic (not shown in FIG. 3) gives the door an opening or closing command. In the case of elevators having no tacho signal available, the motion of the elevator door has to be monitored by some other method. One method is to mount an acceleration sensor on a door leaf to monitor door acceleration. The measured acceleration $a_d$ is passed to an information collection and preprocessing block 31. As in the above-described block 21, this preprocessing block 31 filters the door motion data to exclude door opening operations where the door has to be re-opened during a closing movement due to an obstacle appearing in the path of the door. In block 31, the velocity $v_d$ of the door is then calculated using the following basic formula, based on measured accelerations:

$$v_{d,k} = v_{d,0} + \sum_k a_{d,k}(m_d, F_\mu, F_{tilt}) \cdot dt_k, \quad (8)$$

where $v_{d,0}$ is the initial speed of the door at instant t=0. In other respects, preprocessing block 31 functions like the preprocessing block 21 in FIG. 2. The signals between block 31 and the dynamic model 32 of the door are as in the method of FIG. 2 with the difference that the error term E is calculated from accelerations instead of velocities.

$$E(m_d, F_\mu, F_{tilt}) = \sum_k w_k e_k(m_d, F_\mu, F_{tilt})^2 = \min, \quad (7c, 7d)$$

$$e_k = \tilde{a}_{d,k} - a_{d,k}$$

In the model 32, the estimated door acceleration is calculated by formula (5). This information is fed directly into the differentiating block 33, where the measured acceleration, in this case obtained from a sensor, and the estimated acceleration from the model are subtracted from each other. An error term $e_k$ is obtained, which is a three-variable function of the same type as in the example in FIG. 2. The error is squared with desired weightings in block 34 as described above. Similarly, optimizer 35 works in the same way as optimizer 25. As a result, the same three unknown parameters are obtained as above.

In the examples presented in FIGS. 2 and 3 and in the model in FIG. 1, it is possible to fix one or more of the force parameters of the model if it is desirable to simplify the model and calculation with certain assumptions. The analysis performed by the optimizer can be simplified e.g. by assuming the door mass to be constant. Still, the door mass has to be determined in connection with start-up of the system. In practice, the mass in the model is fixed as a value obtained as the average of the masses obtained e.g. from the first 20 door operations at each floor. After this "teaching period", the optimizer has to find values for the two unknown parameters, the friction resisting door motion and the force caused by tilt of the door. The amount of calculation work is now reduced and the task of finding the parameters becomes easier. After the teaching period, the method works like the method in FIG. 2 or 3 with the difference that $m_d$ is now a fixed constant parameter and that both $e_k$ and E are functions of two variables.

A possible type of failure of an elevator door is failure of the door closing device. This may occur e.g. if the closing weight has been removed during maintenance and the serviceperson has forgotten to mount it again. Another cause of failure may be breakage of the wire cable of the closing weight. Such a fault appears as an abrupt large increase of the force $F_{tilt}$ caused by inclination. It can be inferred that such a large tilt of the door is not the result of an actual tilt but of disappearance of the closing force. This leads to a need to automate the process of inferring the operational state of the closing device by an appropriate method. Genetic algorithms can be used for this purpose. By using such algorithms, it is possible to simultaneously determine both the correct door model (with a closing device either included or not) and the unknown forces $F_{\mu d}$ and $F_{tilt}$. While searching to find the frictional and tilt forces, the genetic optimizer at the same time finds the model of the system that will produce the smallest tilt force.

The principle of genetic algorithms is to create an artificial evolution via processor computing logic. The issue is how to attain an optimal outcome ("phenotype") by changing the properties ("genes") of a "population". The expedients used as a process of change, i.e. genetic operations, are "selection", "crossbreeding" and "mutation". The strongest members of the population "survive" and their properties are inherited by subsequent generations. In an example of the method of the present invention, the population is a set of parameter vectors in the model. In this context, one parameter vector corresponds to one chromosome. Each chromosome has genes. Each gene in this context corresponds to one model parameter to be optimized, these parameters now being operation of the closing device, frictional force of the door and tilt force of the door. The solution represented by these three genes can be called a phenotype. In the operation of the genetic algorithm, first a population is created with gene values selected at random. For each chromosome in the population, a "performance" or goodness value is calculated, which in the present example is the above-described squared error term calculated from the dynamic model of the door. In the genetic algorithm, the search proceeds by generations. From each generation, the chromosomes with the best performance, i.e. those giving the smallest squared error term value, are selected for inclusion in the next generation. From the best alternatives after the selection, the next generation is created using crossbreeding and mutation. As a result of the genetic operations, a new, modified population is obtained, in which the phenotype of the chromosomes differs from the previous population either completely or in only some of the genes. For the new population, performance values, i.e. squared error terms are calculated, thus further producing a chromosome with the best performance. After this, the number sequence of the squared error terms is examined to determine whether it converges and whether a sufficient number of generations have been processed to guarantee convergence. As a final result, the genes of the best individual in the last generation show the magnitudes of the unknown forces and the operational state of the closing device.

The operation of the above-described genetic algorithm can be associated with each one of diagrams 2 and 3. Diagram 4 presents, by way of example, the operating principle when the genetic algorithm is associated with diagram 2. As in diagram 2, in diagram 4 the current of the door motor and the tacho pulse signal of the motor are measured. In a preprocessing block 41, the door speed is calculated and then passed to a differentiating block 43 and to a door model 42. In this connection, the door mass is assumed to be constant. The door speed is estimated in the model and likewise passed to the differentiating block 43. A calculator 44 calculating the squared error term and a so-called GA optimizer 45 form a loop, whose operation was described above in connection with the description of the genetic algorithm. The information about the genes is passed from the GA optimizer 45 to the error term calculator 44 and correspondingly the performance value, i.e. the squared error term E is passed from the error term calculator 44 to the GA optimizer 45. As a final result of the search, the optimizer produces the parameters CD, $F_{\mu d}$ and $F_{tilt}$. CD represents the operational state of the closing device, wherein e.g. the value one means faultless operation of the closing device and the value zero means failure of the closing device. These three parameters are passed back to the model, so the model immediately takes the operational state of the closing device into account. Thus, in addition to the force parameters, the model best describing the system is found immediately. The door opening and closing commands come from the door control system (not shown in FIG. 4). The dynamic model of the door is now $$\tilde{a}_{d,k} = \frac{F_{m,k} + F_{tilt} - CD \cdot F_{cd}(x_{d,k}) - \mathrm{sign}(v_{d,k}) \cdot (F_{\mu m} + F_{\mu d})}{m_d + CD \cdot m_{cd}}, \tag{9}$$

where the term CD is one when the closing device is operational and CD is zero when the closing device is non-operational. To enable the genetic algorithm to find the system model that will produce the smallest tilt angle, the tilt force $F_{tilt}$ is also included in the error function $$E(CD, F_\mu, F_{tilt}) = \sum_k w_k e_k(CD, F_\mu, F_{tilt})^2 + (G > G1) \cdot K \cdot F_{tilt} = \min \tag{10}$$

where K is a scaling coefficient, G is the current number of the generation being calculated by the genetic algorithm and G1 is for generation G a limit value after which the tilt force is no longer included in the error function (10). This arrangement has the effect that the search finds the correct system model at the initial stage of the search when G<G1, whereas the values of parameters $F_m$ and $F_{tilt}$ are more precisely defined at the final stage. The value of the term (G<G1) is 1 when G has a value below G1, otherwise the value is 0.

In practice, when a genetic algorithm is used, it is necessary to have in connection with the start-up of the system a period during which the door mass can be determined with sufficient accuracy. During the teaching period, the closing device is assumed to be operational, and $m_d$, $F_{\mu d}$ and $F_{tilt}$ are determined after the first door operation. The calculation is repeated after as many door operations as necessary until the calculated door mass value is found to be sufficiently converged. After this, the system goes over to a post-teaching-period operating mode where the door mass is assumed to be constant but the parameter CD is not. This operating mode was described above in connection with the description of FIG. 4.

At the beginning of operation, a new elevator door has a so-called breaking-in period, during which the parameters obtained from the optimizer may change somewhat as a function of time. After the breaking-in period there follows a period of stable operation, during which the parameters of the system (door) remain practically constant for a long time. After the period of stable operation, there appear some loosening of moving parts and stretching of parts susceptible to stretching. For example, the rollers guiding the door motion on the rail may slide or become worn so that some of the rollers are no longer continuously in contact with the door. The parameters $F_{\mu d}$ and $F_{tilt}$ may also change due to external factors, such as a strong impact against the door.

The above description deals with solutions for optimizing the kinetic parameters of the door. To optimize the door operations, equation (9) is written as $$a_d(I_m(t), \underline{P}) = \frac{F_m(I_m(t)) + F_{tilt} - CD \cdot F_{cd}(x_d(t)) - \mathrm{sign}(v_d(t)) \cdot (F_{\mu m} + F_{\mu d})}{m_d + CD \cdot m_{cd}}, = M_d(I_m, \underline{P}) \tag{11}$$

where $a_d$ is acceleration of the door at instant t, CD is a variable expressing the operational state of the closing device, $\underline{P}=[m_d, F_{\mu d}, F_{tilt}, CD]^T$ represents a vector of the kinetic parameters and $M_d(I_m, \underline{P})$ the dynamic model of the door.

By solving equation (11) to obtain an inverse model of the door, we get $$M_d^{-1}(a_d, \underline{P}) = a_d(m_d + CD \cdot m_{cd}) - F_{tilt} + CD \cdot F_{cd} + \mathrm{sign}(v_d(t)) \cdot (F_{\mu m} + F_{\mu d}) \tag{12}$$

Let us use the expression $G_{T \to F}: T_m \to F_d$ to denote a function wherein the force $F_d$ applied to the door is calculated from the motor torque $T_m$. Next, the instantaneous motor torque is solved by utilizing an inverse dynamic model of the door and the door acceleration.

$$T_m(a_d, \underline{P}) = G_{T \to F}(M_d^{-1}(a_d, \underline{P})) \tag{13}$$

Similarly, the expression $G_{u \to T}$:u $T_m$ is used to denote a function which calculates the torque $T_m$ generated by the motor, corresponding to the motor control quantity u. The motor control quantity u for generating a desired torque $T_m$ is obtained from the expression $$u = G_{u \to T}^{-1}(M_d^{-1}(a_d, \underline{P})) \tag{14}$$

The function between the door velocity and the maximum kinetic energy allowed by elevator regulations is:

$$v_{max} \leq \sqrt{2 \cdot E_{max}/m_d} \tag{15}$$

When the maximum average kinetic energy $E_{\bar{v}}$ and the maximum allowed instantaneous kinetic energy $E_v$ of the door during the door operation as well as the door mass $m_d$ and the door stroke length $W_d$ during the door operation are known, the acceleration $\hat{a}$ of the door and the velocity profile of the door operation can be solved from the equations:

$$\frac{1}{2} m_d \bar{v}^2 = E_{\bar{v}}, \tag{16a, 16b, 16c}$$

$$\frac{1}{2} m_d \hat{v}^2 = E_{\hat{v}},$$

$$\frac{1}{2} \hat{a} t_1^2 + \hat{v} \cdot (t_2 - t_1) + \frac{1}{2} \hat{a} \cdot (t_3 - t_2)^2 = W_d$$

$$\bar{v} = \sqrt{2 \cdot E_{\bar{v}}/m_d}, \ \hat{v} = \sqrt{2 \cdot E_{\hat{v}}/m_d} \tag{16d, 16e}$$

$$\hat{a} = \frac{\bar{v} \cdot \hat{v}^2}{W_d \cdot (\hat{v} - \bar{v})}, \tag{17a, 17b, 17c}$$

$$t_1 = t_3 - t_2 = \frac{\hat{v}}{\hat{a}},$$

$$t_2 - t_1 = \frac{W_d}{\bar{v}} - 2 \cdot \frac{\hat{v}}{\hat{a}}$$

where $\bar{v}$ is average door speed in time interval $0 \rightarrow t_3$, $t_1$ is door acceleration time, $(t_2 - t_1)$ is constant door speed time and $(t_3 - t_2)$ door deceleration time during the door operation. In equations (17a-c), acceleration $\hat{a}$ is assumed to be constant. However, the invention is not exclusively limited to constant acceleration, but the acceleration profile may vary within the limits of the claims. In such cases, the above equations 17a-c are not necessarily valid and the solution has to be implemented by a calculation method applicable in each case.

FIG. 5 presents by way of example a block diagram of a system according to the invention wherein the kinetic parameters of the door are utilized to optimize door operations in the elevator system. In the solution illustrated in FIG. 5, the gain of the door motor controller, the feed-forward torque value of the controller and the door speed profile are determined using estimated kinetic parameters. In the example in FIG. 5, the system is integrated with the door operator 61.

In FIG. 5, reference number 51, denotes a door speed calculation block, the input parameters of which are $E_{\bar{v}}$, $E_v$ and door mass $m_d$. As output parameters of the calculation block 51, a reference velocity $v_r$ consistent with the calculated velocity profile at instant t and a reference acceleration $a_r$ at instant t are obtained.

If a velocity profile with constant acceleration is in used, then the velocity profile calculation block 51 calculates the door velocity profile from equations 16a-e and 17a-c presented above so that the maximum allowed instantaneous kinetic energy $E_v$ of the door and the average kinetic energy $E_{\bar{v}}$ are not exceeded during door operations. In the door opening sequence and closing sequence, different kinetic energies and therefore also different velocity profiles may be allowed. The open/close input parameter indicates whether the current sequence is a door opening or a door closing sequence. Stored in the calculation block 51 are also the door stroke lengths (not shown in FIG. 5) for different doors of the elevator, from which the door stroke length $W_d$ of the door to be controlled in each case is selected by means of input parameter $N_d$. The magnitudes of the kinetic energy parameters $E_{\bar{v}}$ and $E_v$ can also be changed, in practice reduced, for example in situations where the traffic situation in the elevator system is not congested or the passenger-specific identification information indicates the presence of a disabled passenger or some other need for special control. In FIG. 5, the traffic situation in the elevator system and the passenger identification information are presented as general status data $S_t$ and $S_p$.

The measured actual door velocity $v_d$ is subtracted in summing unit 59 from the reference velocity $v_r$ obtained from the calculation block 51 to form a velocity error $v_e$. $v_e$ is an input parameter to a controller 52, which in this connection is a traditional PID controller. The output parameter $u_{PID}$ of the controller is taken to a multiplier 57, where the gain of the controller is changed by a function proportional to the door mass $m_d$. The torque value $T_e$ obtained from the multiplier and the feedforward torque value $T_f$ calculated by the feedforward block 53 are summed in summing unit 58 and the result is taken to the controller card 54 controlling the door motor 56. The door motor 56 controller card 54 produces a control signal u proportional to the motor torque, which signal in the case of a direct-current motor is the current $I_m$ of the door motor. The door motor controller card 54 also produces a measured current value $I_m$ proportional to the torque value $T_a$ of the door motor.

The function of the feedforward block 53 in FIG. 5 is to produce a controller feedforward torque value $T_f$ to compensate for the forces caused by the desired acceleration applied to the door mass, the friction and tilt angle of the door and the door closing device. For the calculation of the feedforward torque value, the solution presented in equation 13 is applied.

Reference number 55 in FIG. 5 denotes an estimation block for the estimation of the kinetic parameters $\underline{P}$ of the elevator door. In this block, one or more of the kinetic elevator door parameters of the elevator system, which in the case of a system as illustrated in FIG. 5 are door mass $m_d$, frictional force $F_{\mu d}$ acting on the door, force $F_{tilt}$ caused by inclination of the door and operational state CD of the door closing device, are estimated on the basis of the measured torque value $T_a$ and the measured elevator door velocity value $v_d$. Methods applicable for the estimation of the parameters are presented above in FIGS. 2, 3 and 4. The parameter estimation block 55 contains a memory means 60, in which the kinetic parameters of different doors in the elevator system can be stored. To select door-specific kinetic parameters from the aforesaid memory means, the input parameter $N_d$ is used. $N_d$ defines the door being controlled in each case by the door operator. In the case of elevators with an elevator car having only one door, $N_d$ is e.g. the index of the floor at which the elevator car of the elevator is currently located, or when the elevator car is moving between floors, the index of the destination floor of the elevator. This input parameter $N_d$ is generated by the elevator control system (not shown in FIG. 5) or by a floor detector (not shown in FIG. 5) moving with the elevator car. In FIG. 5, the parameter estimation block 55 is integrated with the control unit of the door operator, but it can also be implemented as a separate calculation unit communicating with one or more door operators via a communication link, e.g. a wireless communication link, for the reading of measurement data and transmission of estimated parameters to the door operators.

It is obvious to the person skilled in the art that the invention is not limited to the embodiments described above, in which the invention has been described by way of example, but that different embodiments of the invention are possible within the cope of the inventive concept defined in the claims presented below.

The invention claimed is:

1. A method for improving the performance of an elevator system, said elevator system including at least one elevator, said elevator including at least one elevator door and at least one door operator for opening and closing said elevator door, the method comprising:

measuring the torque of a door motor moving said at least one elevator door and at least one of the acceleration and velocity of the elevator door;

creating for the elevator door a dynamic model incorporating the forces acting on the elevator door;

estimating kinetic parameters of the elevator door via the use of the aforesaid measured acceleration or the aforesaid measured velocity and the aforesaid measured torque and the dynamic model of the elevator door;

modeling in the dynamic model of the elevator door the acceleration or velocity of the elevator door as a function of one or more kinetic parameters, said parameters being mass of the elevator door, frictional force acting on the elevator door, force caused by the tilt angle of the elevator door and operational state of the closing device;

calculating a first error function either as the difference between the measured instantaneous acceleration of the elevator door and the instantaneous elevator door acceleration modeled in the model or as the difference between the measured instantaneous velocity of the elevator door and the instantaneous elevator door velocity modeled in the model;

calculating a second error function by squaring the first error function and summing the squared first error functions obtained over a certain time interval with desired weighting coefficients;

calculating one or more of the aforesaid parameters by minimizing the second error function;

feeding back the calculated parameters to the dynamic model for use in the next calculation cycle; and optimizing the operation of the elevator door via the use of the estimated kinetic parameters to improve the performance of the elevator system.

2. A method according to claim 1, wherein the acceleration of the elevator door is measured by using an acceleration sensor.

3. A method according to claim 1, wherein the velocity of the elevator door is measured by using a signal proportional to the velocity or position of the door, obtained from the door motor.

4. A method according to claim 1, wherein the parameters used as input parameters of the dynamic model consist of one or more of the following: acceleration of the elevator door, velocity of the elevator door, torque of the door motor actuating the elevator door, frictional torque of said motor, force factor of the closing spring of the elevator door, and mass of the closing weight of the elevator door.

5. A method according to claim 1, wherein, by utilizing the dynamic model of the elevator door, one or more the kinetic parameters of the elevator door are estimated, said parameters being mass of the elevator door, frictional force applied to the elevator door, force caused by the tilt angle of the door, and operational state of the closing device.

6. A method according to claim 1, wherein one or more of the kinetic parameters of the elevator door are determined in connection with the start-up of the elevator, and these kinetic parameters are defined as constant parameters in the dynamic model of the elevator door.

7. A method for improving the performance of an elevator system, said elevator system including at least one elevator, said elevator including at least one elevator door and at least one door operator for opening and closing said elevator door, the method comprising:

measuring the torque of a door motor moving said at least one elevator door and at least one of the acceleration and velocity of the elevator door;

creating for the elevator door a dynamic model incorporating the forces acting on the elevator door;

estimating kinetic parameters of the elevator door via the use of the aforesaid measured acceleration or the aforesaid measured velocity and the aforesaid measured torque and the dynamic model of the elevator door;

using a genetic algorithm for detecting the operational state of the closing device of the elevator door;

using in the genetic algorithm a chromosome consisting of genes describing the operation of the closing device, the frictional force acting on the elevator door, and the force caused by the tilt angle of the elevator door;

using a squared error function as a goodness value of the genetic algorithm; and using the dynamic model of the door in the determination of the phenotype of the genetic algorithm; and optimizing the operation of the elevator door via the use of the estimated kinetic parameters to improve the performance of the elevator system.

8. A method according to claim 7, wherein one or more of the control parameters of the controller of the door motor actuating the elevator door are determined by utilizing the kinetic parameters of the elevator door, said control parameters being gain of the controller and controller feedforward torque value.

9. A method according to claim 7, wherein the velocity profile of the elevator door is determined by using one or more auxiliary parameters, said auxiliary parameters being maximum allowed instantaneous kinetic energy of the elevator door, maximum allowed average kinetic energy of the elevator door, traffic condition of the elevator system, passenger-specific identification data.

10. A method according to claim 7, wherein the estimated kinetic parameters of one or more elevator doors are stored in the elevator system, and the kinetic parameters to be used in the optimization of the functions of the elevator door are selected from the said stored parameters on the basis of an external selection signal.

11. A method according to claim 10, wherein the external signal used for the selection of kinetic parameters is a signal indicating the destination floor, said signal being generated in the elevator control system or in the group control of the elevator system.

12. A method according to claim 10, wherein the external signal used for the selection of kinetic parameters is a signal generated by a floor detector moving with the elevator car.

13. A system for improving the performance of an elevator system, said elevator system including at least one elevator, said elevator including at least one elevator door and at least one door operator (61) for opening and closing said elevator door, the system comprising:

a measuring unit that measures the torque of a door motor moving said at least one elevator door and at least one of the acceleration and velocity of the elevator door;

a dynamic model of the elevator door, incorporating the forces acting on the elevator door an estimation unit that estimates kinetic parameters of the elevator door using the measured acceleration or the measured velocity and the measured torque of the motor moving the elevator door and the dynamic model of the elevator door;

an optimization unit that modifies the operation of the elevator door based on the estimated kinetic parameters to improve the performance of the elevator system;

a modeling unit that models the acceleration or velocity of the elevator door in the dynamic model, said acceleration or velocity being defined as a function of one or more kinetic parameters of the elevator door, such parameters being mass of the elevator door, frictional force acting on the elevator door, force caused by the tilt angle of the elevator door and operational state of the closing device;

a first error calculator that calculates a first error function, said error function being obtained either as the difference between the measured instantaneous acceleration of the elevator door and the instantaneous elevator door acceleration modeled in the model or as the difference between the measured instantaneous velocity of the elevator door and the instantaneous elevator door velocity modeled in the model;

a second error calculator that calculates a second error function, said second error function being obtained by squaring the first error function and summing the squared first error functions obtained over a certain time interval with desired weighting coefficients;

a first optimization unit that minimizes the second error function, thereby determining one or more of the kinetic parameters of the elevator door; and a first feedback unit that passes the calculated parameters to the dynamic model for use in the next calculation cycle.

14. A system according to claim 13, wherein the system further comprises a signal $a_d$ proportional to acceleration as a means of measuring door acceleration.

15. A system according to claim 13, wherein the system further comprises a signal $v_d$ proportional to the velocity or position of the door, obtained from the door motor and used as a means of measuring door velocity.

16. A system according to claim 13, wherein the system further comprises means for determining one or more parameters of the dynamic model (22,32,42) via actions which are measurement of elevator door acceleration, measurement of elevator door velocity, measurement of the current of the door motor moving the elevator door, determination of the torque coefficient one of the door motor, determination of the frictional torque of the motor, determination of the force factor of the closing spring of the elevator door, and determination of the mass of the closing weight of the elevator door.

17. A system according to claim 13, wherein the kinetic parameters to be estimated in the system are one or more of the following parameters (P): mass of the elevator door, frictional force applied to the elevator door, force caused by the tilt angle of the door, and operational state of the closing device.

18. A system for improving the performance of an elevator system, said elevator system including at least one elevator, said elevator including at least one elevator door and at least one door operator (61) for opening and closing said elevator door, the system comprising:

a measuring unit that measures the torque of a door motor moving said at least one elevator door and at least one of the acceleration and velocity of the elevator door;

a dynamic model of the elevator door, incorporating the forces acting on the elevator door;

an estimation unit that estimates kinetic parameters of the elevator door using the measured acceleration or the measured velocity and the measured torque of the motor moving the elevator door and the dynamic model of the elevator door;

an optimization unit that modifies the operation of the elevator door based on the estimated kinetic parameters to improve the performance of the elevator system and;

a third optimization unit that;

uses a genetic algorithm to detect the operational state of the closing device of the elevator door;

uses one or more kinetic parameters in the genetic algorithm as genes of a chromosome, said parameters being operation of the closing device, frictional force applied to the door and force caused by the tilt angle of the door;

a squared error function (44) as a goodness value of the genetic algorithm; and uses the dynamic model of the door in the determination of the phenotype of the genetic algorithm.

19. A system according to claim 18, wherein the system further comprises a control parameter determination unit that determines the control parameters of the controller of the door motor moving the elevator door, said control parameters being gain of the door motor and controller feedforward torque value.

20. A system according to claim 18, wherein the system further comprises: a velocity profile determination unit that determines the velocity profile of the elevator door by using one or more auxiliary parameters, said auxiliary parameters being maximum allowed instantaneous kinetic energy of the elevator door, maximum allowed average kinetic energy of the elevator door, traffic condition $S_t$ of the elevator system, passenger-specific identification data $S_p$.

21. A system according to claim 18, wherein the system further comprises a memory that stores the kinetic parameters of one or more elevator doors to the elevator system, the kinetic parameters to be used in the optimization of the functions of the elevator door being selectable from among the said stored parameters by using an external selection signal.

22. A system according to claim 21, wherein the external selection signal for selecting the kinetic parameters is a signal indicating the destination floor, which signal has been generated in the elevator control system or in the group control of the elevator system.

23. A system according to claim 21, wherein the external selection signal for selecting the kinetic parameters has been generated by a floor detector moving with the elevator car.

* * * * *